United States Patent [19]

Poblete et al.

[11] Patent Number: 4,856,420

[45] Date of Patent: Aug. 15, 1989

[54] FUME HOOD

[75] Inventors: Rudolph G. Poblete, Statesville; Kurt Rindoks, Cornelius; James R. Frederick, Statesville, all of N.C.

[73] Assignee: Kewaunee Scientific Corporation, Statesville, N.C.

[21] Appl. No.: 208,582

[22] Filed: Jun. 20, 1988

[51] Int. Cl.[4] ..... B08B 15/02

[52] U.S. Cl. ..... 98/115.3; 312/138.1

[58] Field of Search ..... 98/115.3; 312/138 R

[56] References Cited

U.S. PATENT DOCUMENTS

| | | | |
|---|---|---|---|
| 1,054,959 | 3/1913 | Anderson | 312/138 R |
| 1,431,371 | 10/1922 | Chapman | 312/138 R |
| 2,715,359 | 8/1955 | Mackintosh et al. | 98/115.3 |
| 3,111,077 | 11/1963 | Cortright | 98/115.3 |
| 3,121,618 | 2/1964 | Yerzley | 98/115.3 X |
| 3,604,333 | 9/1971 | Nelson | 98/115.3 |
| 3,726,206 | 4/1973 | Worick, Jr. | 98/115.3 |
| 3,729,243 | 4/1973 | Musgrave et al. | 312/138 R X |
| 3,941,040 | 3/1976 | Carlson | 98/115.3 |
| 4,249,463 | 2/1981 | Hornby | 98/115.3 |
| 4,377,969 | 3/1983 | Nelson | 98/115.3 |
| 4,553,992 | 11/1985 | Boissinot et al. | 98/115.3 X |

OTHER PUBLICATIONS

Catalog No. FH-51, entitled "Laboratory Fume Hoods", published by Kewaunee Scientific Equipment Corp., 1975.

*Primary Examiner*—Harold Joyce

[57] ABSTRACT

Fume hoods with sash controlled airflow paths are provided with inwardly inclined upright transparent sash and outwardly inclined transparent top panels to increase visibility of the hood interior. The tilted or angled transparent upright sash facilitates outside viewing of articles inside the hood since a viewer standing in front of the hood can look down on the articles without reflective glare from outside lighting while at the same time the outwardly inclined transparent panel above the closed sash captures the outside lighting to enhance the interior illumination of the hood and allows clear vision into the upper part of the cabinet.

9 Claims, 1 Drawing Sheet

FUME HOOD

BACKGROUND OF THE INVENTION

1. Field of the Invention

This invention relates to fume hoods for laboratories and the like which have open front cabinets closed by transparent lift sash that are inclined inwardly to increase interior visibility and specifically this invention relates to laboratory fume hoods having open front cabinets with waist high floors and upright lift sash windows above the floor controlling airflow which are inclined inwardly and have outwardly inclined transparent panels above the sash openings.

2. Description of Prior Art

Heretofore known laboratory fume hood cabinets with waist or desk (3-3-½ feet) high floors or article receiving platforms have had vertical lift sash closing and giving access to the cabinet with the front of the cabinet above the sash opening being closed by opaque front vertical panels. The vertical lift sash was raised behind the panels, opening the front of the cabinet below the panels and blocking airflow behind the panels. This vertical sash, even though it had a transparent window, reflected outside light and did not give clear vision to articles on the floor in the cabinet. The opaque top front panels of the cabinet blocked lighting of the cabinet from exterior light sources and prevented clear vision to articles in the upper part of the cabinet.

It would therefore be an improvement in this art to so mount the lift sash of fume hoods to increase interior visibility and decrease required lift space.

It would be a further improvement to increase the lighting of the fume hood cabinet from outside sources without adding equipment and allow vision to entire interior of the cabinet.

A specific improvement is tilting lift sash of fume hoods inwardly about 5 to 20 degrees from vertical.

SUMMARY OF THE INVENTION

According to this invention laboratory fume hoods with open front cabinets above waist high floors or platforms have inwardly inclined upright lift sash windows closing the open front of the cabinet in the "down" position and giving access to the cabinet floor in the "up" position. The inward inclination of the sash gives better visibility of the entire floor area when the sash is closed. In addition, the sash controls airflow patterns through the cabinet. Further, an inwardly inclined transparent panel closes the open front of the cabinet above ths sash opening to increase visibility in the cabinet. The angle of inclination of the transparent sash is preferably about five to twenty degrees inwardly from the vertical so that when articles on the waist high cabinet floor are viewed through the closed sash from eye level, light reflection through the window and outside light reflection from the window will be minimized to give unobstructed vision to the entire floor area.

The outward inclination of the transparent top panel above the sash opening not only transmits outside light into the cabinet, but also tends to reflect some of this light toward the floor of the cabinet to increase visibility.

The open front of the cabinet is bordered by beveled or outwardly flaring facia surrounding the sash and transparent top panel to provide an attractive front finish for the fume hood.

The invention will be further understood from the following description and the showings in the attached sheet of drawings in which.

BRIEF DESCRIPTION OF ILLUSTRATED EMBODIMENT

Figure 1:
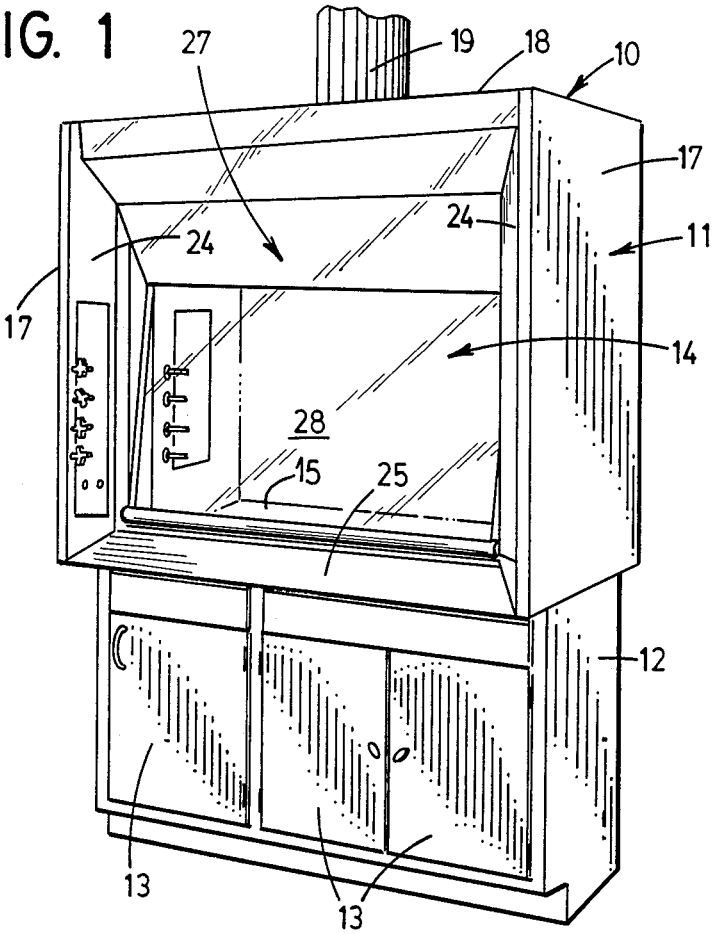
FIG. 1 is a perspective front and side elevational view of a fume hood of this invention.

The reference numeral 10 of FIGS. 1–4 indicates generally a fume hood of this invention in the form of an upright rectangular cabinet 11 on a base pedestal 12 providing storage space under the cabinet level which is closed by front doors 13, 13. The cabinet 11 and its base 12 can be integral and are conventionally mounted on a laboratory floor in front of a wall or built into a wall. The cabinet 11 has an open front 14, a waist high floor 15, a closed vertical back wall 16, and vertical end or sidewalls 17, 17. The roof 18 of the cabinet has a large upright outlet duct 19 adjacent the back wall 16. A light fixture 20 is provided in the roof 18 in front of the duct 19 to selectively illuminate the cabinet 11.

Upright baffles 21 and 22 spaced in front of the back wall 16 provide airflow paths in the cabinet 11 to the outlet duct 19. The top of the cabinet 11 projects forwardly beyond the roof 18 providing an opening 23 to the top of the cabinet 11.

The sides of the open front of the cabinet are bordered by outwardly flaring facia 24 connected at their bottom ends by a similar facia strip 25. An opening 26 under and behind the bottom facia strip 25 vents outside air into the interior of the cabinet just above the floor 15.

The front ends of the tops of the sidewalls or end walls 17, 17 of the cabinet mount a transparent or clear top panel 27 which spans the upper portion of the open front of the cabinet and slopes inwardly and downwardly at an angle of about 20 to 60 degrees (preferably about 25°) from the vertical to the top of the sash opening which is opened and closed by an inwardly inclined upright window sash 28. The panel can be formed of clear type plastic or glass. The window sash can be glass with a surrounding wood, plastic or metal frame. This window sash 28 rides in tracks or guides 29 mounted on the inner faces of the side or end walls 17, 17. Sash lift assist devices, such as springs, counterweights or the like, (not shown) balance the sash for easy manual operation at any level between a fully closed position to the fully opened position.

In its fully opened or "up" position, the sash blocks the opening 23 shutting off air intake to the top of the interior of the cabinet 11.

Figure 3:
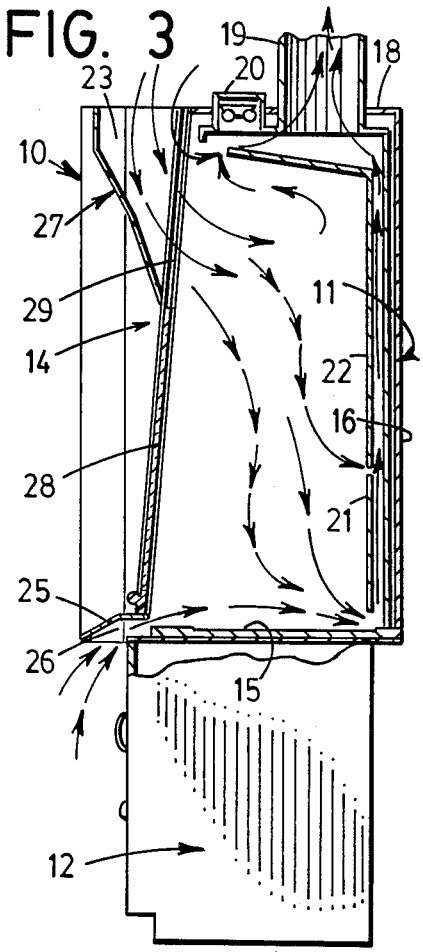
FIG. 3 is a vertical cross sectional view with parts in end elevation along the line III—III of FIG. 2 and showing the airflow paths when the sash is in closed or "down" position.
Figure 4:
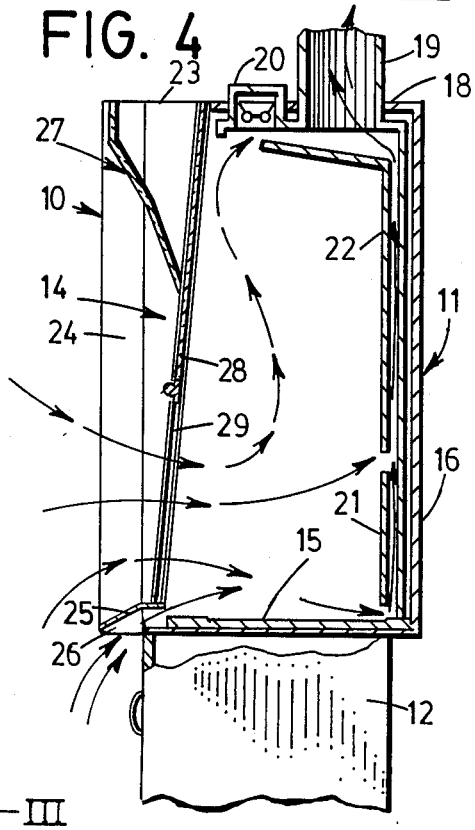
FIG. 4 is a view similar to FIG. 3 with the sash in open or "up" position and showing the airflow paths under such conditions.

The airflow patterns through the cabinet are illustrated in FIGS. 3 and 4. As shown in FIG. 3, when the sash 28 is in its closed or down position, air enters the bottom opening 26 under the bottom facia 25 to sweep over the floor 15 of the cabinet and exit behind the lower panel 21. Air also enters through the top opening 23 behind the top panel 27 to sweep over the bottom 15 and exit under the baffle panels 21 and 22 with some of the air also flowing over the top of the panel 22. All of the air, of course, is exhausted through the duct 19 which is connected to an exhaust fan or blower (not shown) vented to the outside of the laboratory.

In the open or up position of the sash, the airflow patterns are illustrated in FIG. 4 where all of the air enters through the front of the cabinet under the open sash and also under the bottom facia 25.

Figure 2:
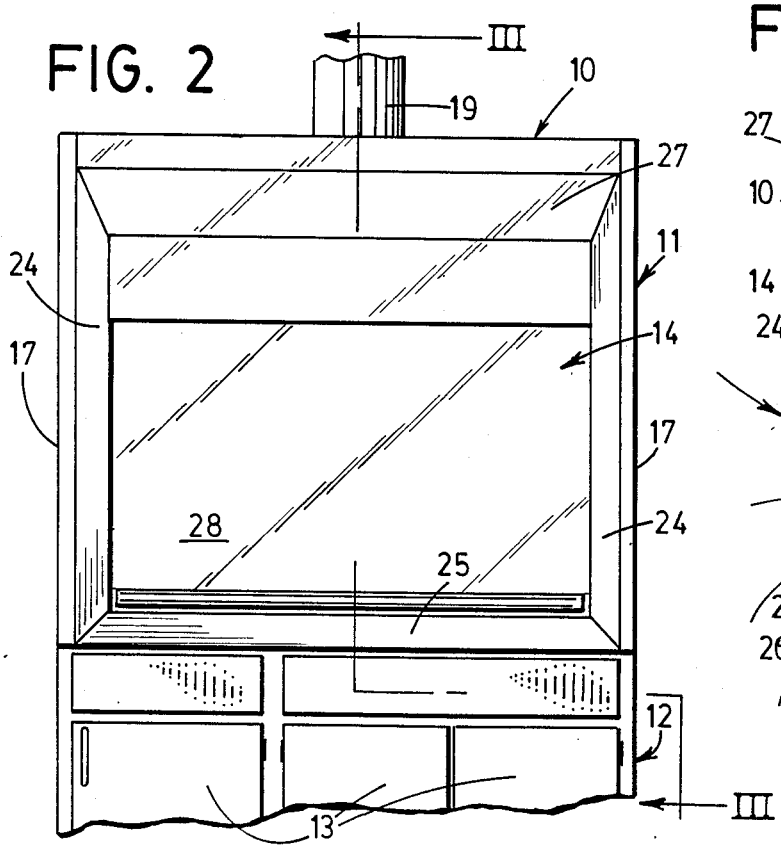
FIG. 2 is a fragmentary front elevational view of the fume hood of FIG. 1.

The inward sloping of the sash, as pointed out above, provides clear visibility to the entire bottom 15 of the cabinet when the sash is in closed position as illustrated in FIGS. 1, 2 and 3. Thus, the eye level of a person standing in front of the closed cabinet would be above the sash and the line of sight to the bottom 15 of the interior of the cabinet would be through the glass of the closed sash at an angle that would not be distorted by the glass and would give clear vision to the entire floor 15. Light from an exterior source would not be reflected back to the viewer.

Further, the transparent panel 27 above the closed sash 28 gives a full view of the top portion of the cabinet and transmits exterior light to further illuminate the cabinet. Any reflected light is downward.

The above descriptions and showings should therefore fully demonstrate to those skilled in this art, a complete understanding of the invention and a preferred mode arrangement.

We claim as our invention:

1. In a fume hood having an open front cabinet opened and closed by a transparent upright lift sash which also controls air flow patterns through the cabinet and a top panel mounted across the front of the cabinet above the opening closed by the lift sash, and said cabinet having an air intake passage behind said panel, the improvements of said top panel being transparent and the lift sash being inwardly inclined from the vertical in a bottom to top direction to increase viewing of the cabinet interior and to open said air intake passage in its closed position and close said air intake passage in its opened position.

2. The improvement of claim 1 wherein the angle of inclination of the lift sash is from 5 to 20 degrees from the vertical.

3. The further improvement of claim 1 wherein the transparent panel slopes from top to bottom inwardly to the lift sash to cooperate therewith for closing the open front of the cabinet.

4. The hood of claim 3 wherein the inward slope of the panel is about 20 to 60 degrees from vertical.

5. A laboratory fume hood which comprises an upright generally rectangular open front cabinet having a waist high floor, a roof with an exhaust duct projecting therefrom producing an air flow through the cabinet, baffles in the cabinet directing the airflow to the exhaust duct, a transparent top panel inclined inwardly in a top to bottom direction closing the upper portion of the open front of the cabinet and spaced forwardly of said roof to provide a top opening to the interior of the cabinet, an upright transparent lift sash, tracks in said cabinet mounting said lift sash along a path inclined inwardly in a bottom to top direction from a bottom closed position cooperating with the top panel to close the front of the cabinet to an upward position opening the front of the cabinet below the top panel and blocking off the airflow through the top opening behind the panel whereby in the closed position of the sash, view of the interior of the cabinet is facilitated and light is transmitted through the top panel to illuminate the cabinet.

6. The hood of claim 5 wherein the top panel spans the entire open front of the cabinet and mates with the sash at its inner end.

7. The hood of claim 5 wherein the tracks are mounted upright on the insides of the sidewalls of the cabinet and extend from the floor to the roof of the cabinet at an angle of 5 to 20 degrees.

8. A laboratory fume hood which comprises a generally rectangular cabinet with an open front bordered on the bottom and sides by outwardly flaring facia, a transparent top panel spanning the open front of the cabinet between the side facia, a transparent upright lift sash closing the open front of the cabinet below the top panel, said cabinet having a roof with an exhaust duct extending therefrom, baffles in the back of the cabinet directing airflow to the roof, said cabinet having a top opening behind the top panel, said lift sash blocking said opening in its open position, said bottom facia having an air inlet thereunder directing air to the bottom of the cabinet, and means on the cabinet mounting said lift sash for travel from bottom to top along an inwardly inclined path of about 5 to 20 degrees from the vertical.

9. The hood of claim 8 wherein the top panel slopes downwardly and inwardly to the sash.

* * * * *